United States Patent [19]

Bergeron

[11] Patent Number: 4,643,612

[45] Date of Patent: Feb. 17, 1987

[54] OIL CLEANUP BARGE

[75] Inventor: Robert P. Bergeron, Gretna, La.

[73] Assignee: Shell Offshore Inc., Houston, Tex.

[21] Appl. No.: 682,725

[22] Filed: Dec. 17, 1984

[51] Int. Cl.[4] ..... E02B 15/04

[52] U.S. Cl. ..... 405/60; 210/922; 405/52; 405/210

[58] Field of Search ..... 405/60, 210; 210/923, 210/924; 114/62; 441/67

[56] References Cited

U.S. PATENT DOCUMENTS

| | | | |
|---|---|---|---|
| 3,310,124 | 3/1967 | Farmer | 405/133 X |
| 3,674,150 | 7/1972 | Le Jeune | 210/923 X |
| 3,879,951 | 4/1975 | Mason | 405/60 |
| 3,981,154 | 9/1976 | Hix | 405/60 |
| 4,245,930 | 1/1981 | Gefvert | 405/60 X |
| 4,358,218 | 11/1982 | Graham | 405/60 |
| 4,405,258 | 9/1983 | O'Rourke et al. | 405/60 |
| 4,531,860 | 7/1985 | Barnett | 210/923 X |

FOREIGN PATENT DOCUMENTS

| | | | |
|---|---|---|---|
| 2488928 | 2/1982 | France | 405/60 |
| 7711698 | 4/1979 | Netherlands | 405/60 |
| 2055414 | 3/1981 | United Kingdom | 405/60 |
| 2071020 | 9/1981 | United Kingdom | 405/60 |

*Primary Examiner*—Dennis L. Taylor

[57] ABSTRACT

An oil storage barge having a concave bottom is adapted to be anchored over a subsea well or pipeline that is leaking oil. Flexible skirts extend to the ocean floor, and oil that is trapped under the barge may be stored in the barge or then transferred to another vessel.

1 Claim, 2 Drawing Figures

FIG. 1
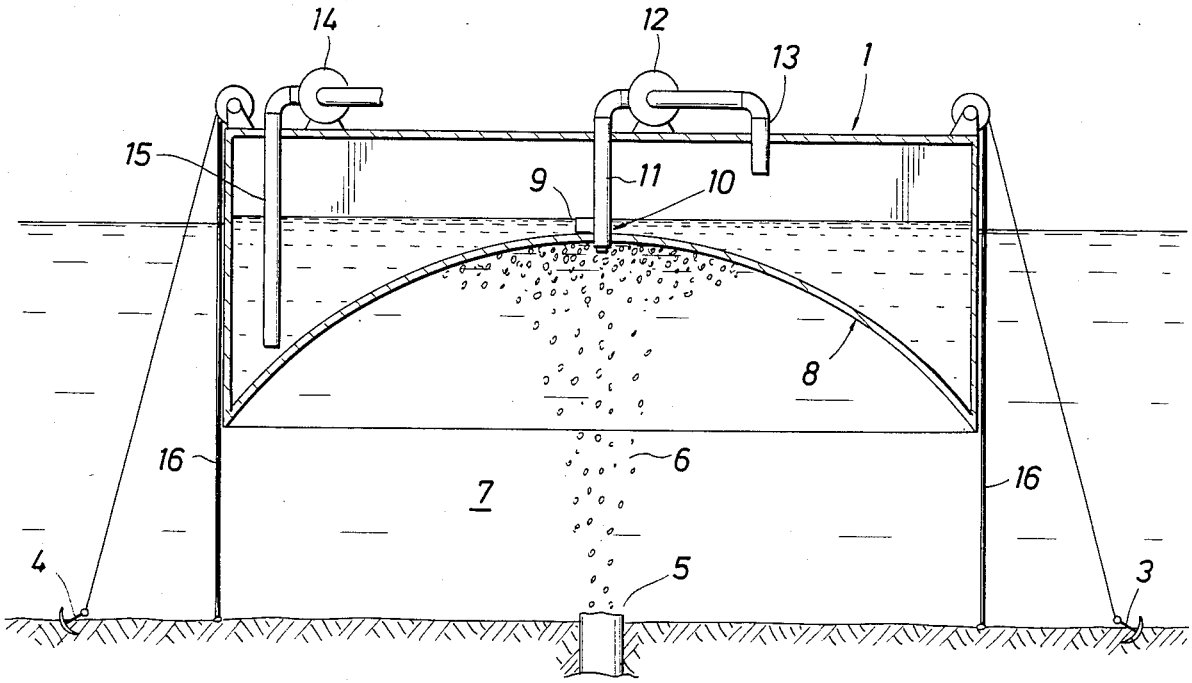
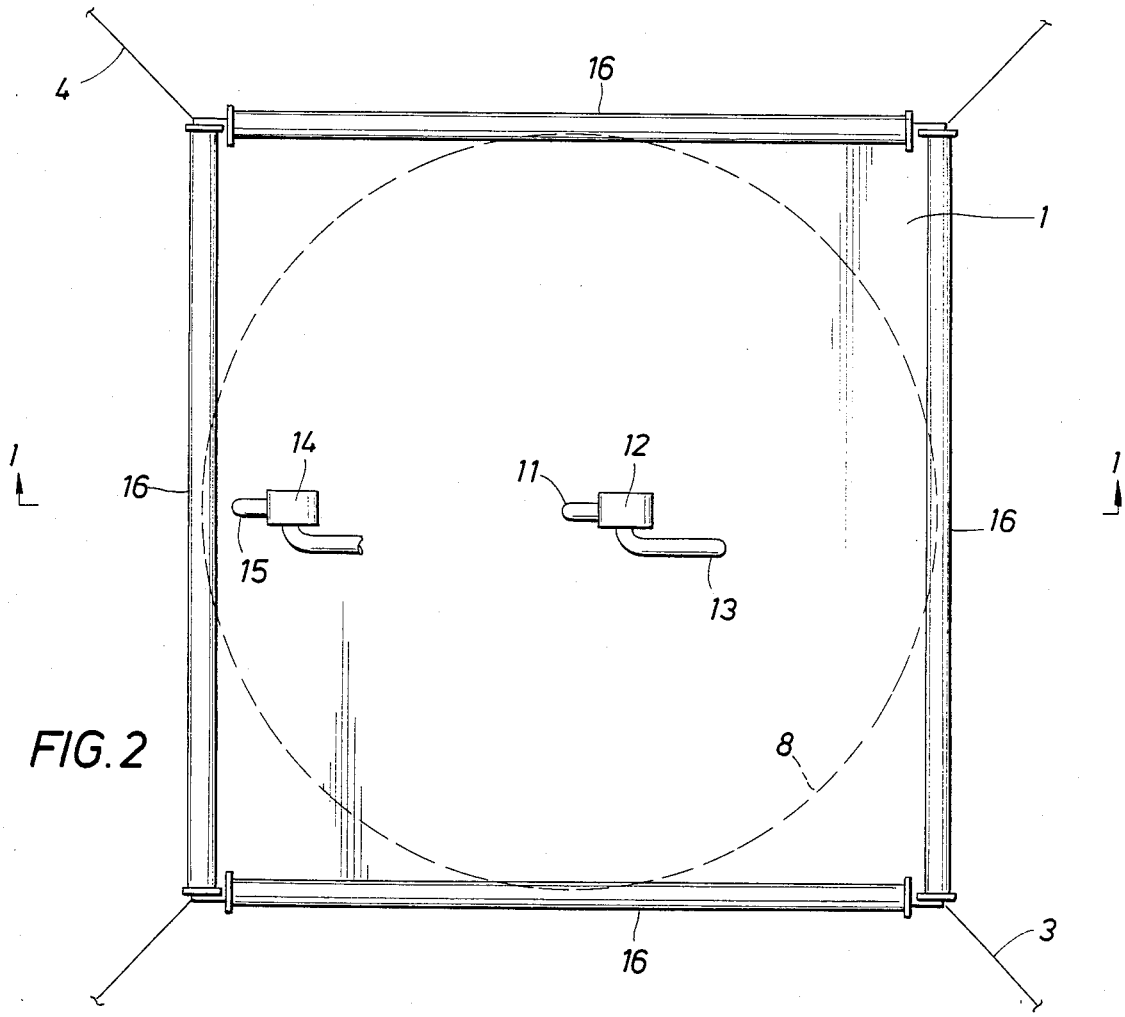
FIG. 2

OIL CLEANUP BARGE

BACKGROUND OF THE INVENTION

The present invention relates to an anti-pollution device for collecting fluids escaping from an underwater source, particularly hydrocarbons released through fractures of the sea bottom, or from an underwater well, a sunken ship, or an underwater pipe.

Numerous efforts have been made to isolate oil leaking from an underwater source, but usually such efforts have been related to confining the oil at the surface, rather than preventing the stream of oil from being deflected laterally by underwater currents. If the current is strong enough and/or the depth great enough, the escaping oil may be carried substantial distances from any oil recovery apparatus that is located at the surface.

Yet another deficiency of previously proposed apparatus for recovering or confining oil leakage is the amount of time required for installing the apparatus at the required location. Usually, leakage occurs unexpectedly, and it is necessary to take action promptly before large quantities of oil are accumulated on the surface of the water.

Recently, the blowout from Ixtoc I oil well in the Gulf of Mexico revealed the pollution risk involved in offshore drilling operations and illustrated the necessity for using equipment for substantially reducing or eliminating the risk of such pollution until, after the blowout, the well can again be controlled. It is difficult to place and hold prior art devices in position over a source of fluids escaping under pressure, such as a blown well, due to the turbulence produced by the hydrocarbon jet escaping from the well. The art is clearly deficient in its capability for handling escaping oil from such blowouts.

Applicant is not aware of any prior art which, in his judgment as one skilled in the art of confining and collecting oil leakage, would anticipate or render obvious the novel technique of the present invention; however, for the purposes of fully developing the background of the invention, and establishing the state of the requisite art, the following U. S. Pat. Nos. are set forth: 3,599,434; 4,449,850; 3,879,951; 3,653,215.

SUMMARY OF THE INVENTION

It is a purpose of this invention to provide apparatus for isolating and confining oil leakage from an underwater source which is unaffected by underwater currents. It is a further purpose of the invention to provide oil leakage recovery apparatus which may be quickly positioned over a source of leakage and rapidly placed in operation. A still further purpose of this invention is to provide oil recovery and isolation apparatus which is readily adjustable for various depths of water. However, it is the main purpose of the invention to enable oil leaking from an underwater source to be quickly and effectively confined within a limited area for subsequent withdrawal.

These purposes are accomplished in accordance with a preferred embodiment of the invention by providing a device for capturing oil released by leakage from an underwater source comprising a vessel having a concave bottom and adapted to being positioned over the source of leakage. Preferably, the device includes a flexible skirt extending downwardly from the vessel and encircling oil rising from the source of leakage. More preferably, the device includes means for transferring oil from the apex of the concave bottom to storage means and has a telescoping oil inlet at the apex of the concave bottom.

The advantages of the present invention are many and include more efficient cleanup in the event of major seepage and less need for expensive surface cleanup equipment to stand by, since any seepage will be confined in a predefined area.

Other purposes, distinctions over the art, advantages and features of the invention will be apparent to one skilled in the art upon review of the following.

BRIEF DESCRIPTION OF THE DRAWINGS

FIG. 1 shows an elevational sectional view of the invention.

FIG. 2 provides a plan view of the invention.

DESCRIPTION OF PREFERRED EMBODIMENTS

FIGS. 1 and 2 disclose a barge storage vessel 1 preferably having a rectangular or square shape which is positionable by anchors 3 and 4, or more anchors, over a subsea blowout 5, emitting pollution 6, such as oil and/or gas rising through seawater 7. The barge 1 is provided with a dome shaped or concave bottom 8 which is further provided at or near the apex thereof with an oil inlet 9 which preferably has a telescoping means 10 which is adjustable to lower the inlet into the oil in those instances where there is a gas layer just beneath the apex. Piping 11 transmits the oil and/or gas upwardly via a pump 12 and outlet 13 to storage on the barge or to further transfer to another vessel, or the like. Pump 14 may be utilized to transfer the oil contained on the vessel 1 to other storage or means for recovering oil and/or gas via pipe 15. In order to make the device adjustable to blowouts or the like which are at varying depths, roll-up skirt or curtain 16 is provided which extends around the periphery of the barge. This roll-up skirt is preferably flexible and is of an adjustable length in order to extend down to the seafloor. This skirt serves the function of preventing currents from shifting the oil outside of the bottom of the barge and otherwise interfering with recovery.

The dome-shaped or concave bottom to the barge is especially advantageous inasmuch as it provides a natural means for confining the oil within the bottom of the barge and also facilitates pumping the oil into the barge due to its natural upward force against the apex of the dome-shaped bottom.

Alternatively to the use of anchors 3 and 4, barge 1 can be held in a favorable position from a distant location if necessary by lines attached to tug boats.

The foregoing description of the invention is merely intended to be explanatory thereof, and various changes in the details of the described apparatus may be made within the scope of the pending claim without departing from the spirit of the invention.

What is claimed is:

1. A vessel for capturing oil released by leakage from an underwater source comprising a floating barge having a concave bottom and adapted to being positioned over the source of leakage;

means for transferring oil from the apex of the concave bottom to storage inside the barge which is topside, adjacent and encircling the concave bottom;

a length-adjustable flexible skirt extending downwardly from the barge and encircling oil arising from the source of leakage;

means for transferring oil from the barge storage to other storage means; and a telescoping oil inlet at the apex of the concave bottom operative to lower the inlet through a gas layer and into an oil layer.

* * * * *